US008616898B2

(12) United States Patent
Lee et al.

(10) Patent No.: US 8,616,898 B2
(45) Date of Patent: Dec. 31, 2013

(54) HIGH FREQUENCY COAXIAL CABLE

(75) Inventors: Joon Lee, Carmel, IN (US); David E. Dunham, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 42 days.

(21) Appl. No.: 13/360,215

(22) Filed: Jan. 27, 2012

(65) Prior Publication Data

US 2013/0029520 A1 Jan. 31, 2013

Related U.S. Application Data

(60) Provisional application No. 61/436,764, filed on Jan. 27, 2011, provisional application No. 61/438,874, filed on Feb. 2, 2011.

(51) Int. Cl.
*H01R 12/00* (2006.01)

(52) U.S. Cl.
USPC ..... 439/63

(58) Field of Classification Search
USPC ..... 439/63, 581, 578, 573
See application file for complete search history.

(56) References Cited

U.S. PATENT DOCUMENTS 5,613,859 A * 3/1997 Bellantoni et al. ..... 439/63
5,618,205 A * 4/1997 Riddle et al. ..... 439/581
5,683,255 A * 11/1997 Menze ..... 439/63

* cited by examiner

*Primary Examiner* — Phuong Dinh
(74) *Attorney, Agent, or Firm* — Timothy M. Morella

(57) ABSTRACT

A connector includes a conductive body with a central bore along a central axis. The body includes a mounting face for positioning adjacent a mounting surface of a circuit member and for removably engaging a reference pad of the circuit member. A center conductive contact includes a board engaging end for removably engaging a signal pad of the circuit member. An inner dielectric insert is positioned between the conductive body and the center conductive contact. The conductive body, the center conductive contact and the inner dielectric insert are configured to operate at a frequency of at least 40 GHz with a return loss of greater than 20 dB.

11 Claims, 5 Drawing Sheets

HIGH FREQUENCY COAXIAL CABLE

REFERENCE TO RELATED APPLICATIONS

The Present Disclosure claims priority to prior-filed U.S. Provisional Patent Application No. 61/436,764, entitled "Compression Fit Coaxial Connector For Mounting To A Printed Circuit Board," filed on 27 Jan. 2011 with the United States Patent And Trademark Office; and No. 61/438,874, entitled "High Frequency Coaxial Cable," filed on 2 Feb. 2011 also with the United States Patent And Trademark Office. The contents of each of the aforementioned Patent Applications are fully incorporated in their entireties herein.

BACKGROUND OF THE PRESENT DISCLOSURE

The Present Disclosure relates generally to connectors and, more particularly, to a high frequency coaxial connector for mounting on a circuit member.

Coaxial connectors are often used in applications for transmitting high frequency signals, such as radio frequency ("RF") and microwave signals within the circuitry of a system. In order to reduce signal degradation when transmitting such signals, it is desirable to minimize impedance mismatches along the entire length of the system. As the frequency of the signal increases, even small variations in impedance may degrade system performance.

As the operating frequencies increase, it is often necessary to utilize relatively complex connector and circuit board systems in order to maintain system performance. In general, complexity of the components increases their cost, either due to the purchase price of the components or the complexity of their application and use. While many connectors that perform satisfactorily at frequencies below 30 GHz are not overly complex, connectors and related systems that operate above 30 GHz have proven to be relatively complex and limited in their application. Accordingly, it is desirable to provide a circuit board mountable coaxial connector that will operate both at frequencies above and below 30 GHz, yet retain many of the favorable operating characteristics of lower frequency connectors.

SUMMARY OF THE PRESENT DISCLOSURE

A connector for mounting on a mounting surface of a circuit member, in accordance with the teachings and tenets of the Present Disclosure, includes a conductive body with a central bore along a central axis. The body includes a mounting face for positioning adjacent a mounting surface of the circuit member and for removably engaging a reference pad of the circuit member. A center conductive contact is positioned along the central axis and includes a mating contact end for mating with a mating component and a board engaging end for removably engaging a signal pad of the circuit member. An inner dielectric insert is positioned between the conductive body and the center conductive contact. The conductive body, the center conductive contact and the inner dielectric insert are configured to operate at a frequency of at least 40 GHz with a return loss of greater than 20 dB.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
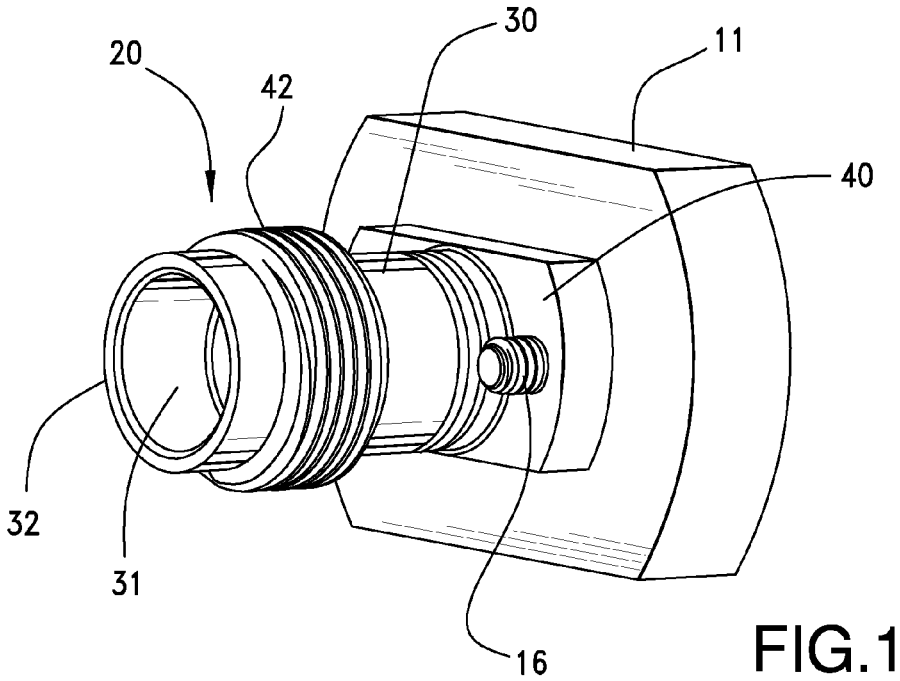
FIG. 1 is a perspective view of a coaxial connector mounted on a circuit member.
Figure 3:
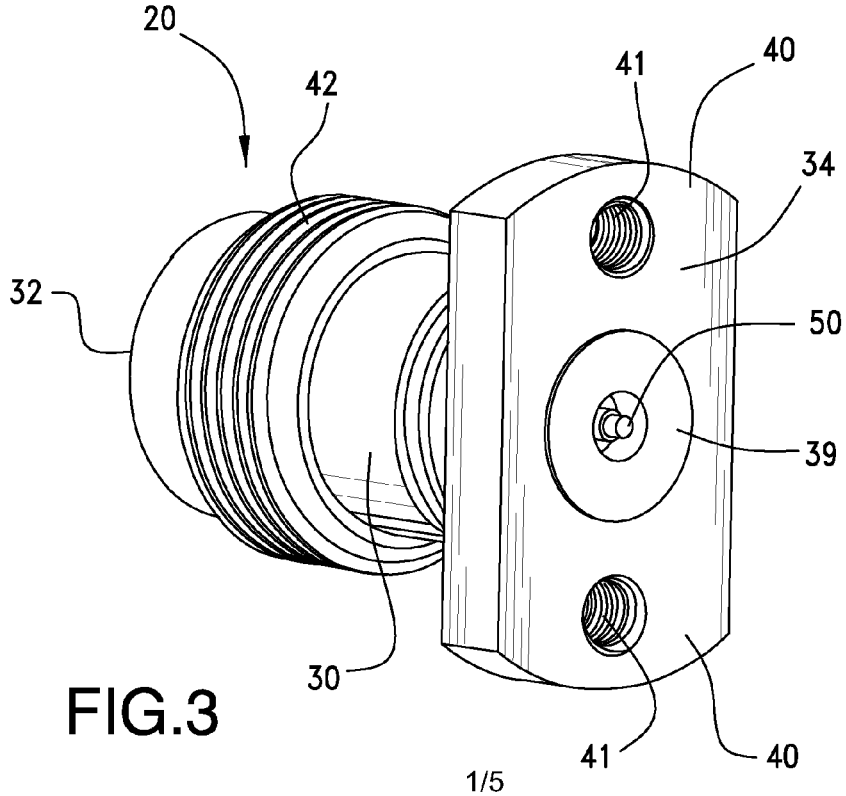
FIG. 3 is a perspective view of the coaxial connector of FIG. 1, as viewed from its mounting face.
Figure 2:
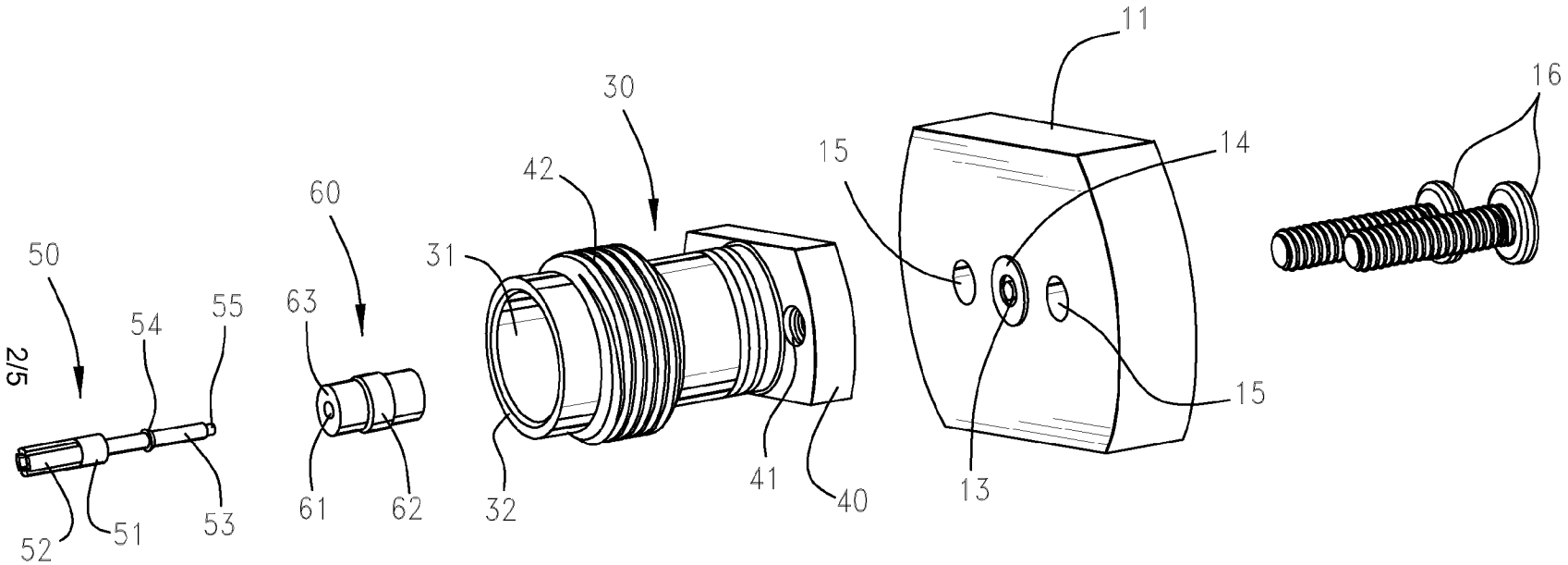
FIG. 2 is an exploded perspective view of the coaxial connector and circuit member of FIG. 1.

Referring to FIGS. 1-2, a high-frequency coaxial connector 20 is mounted on circuit board or member 11. As such, coaxial connector 20 provides a structure for transitioning signals within circuit board 11 to a coaxial transmission line, such as a coaxial cable, in a vertical or perpendicular manner relative to the plane of circuit member 11. The mounting surface of circuit member 11 includes a circular signal contact or pad 13 for transmitting signals through the circuit member and an annular-shaped ground or reference contact or pad 14 that surrounds and is spaced from signal contact or pad 13. Two mounting holes 15 extend through circuit member 11 and are positioned on opposite sides of the signal pad 13 and ground pad 14. Mounting screws 16 may pass through mounting holes 14 and into coaxial connector 20 in order to secure coaxial connector 20 to circuit member 11.

Figure 4:
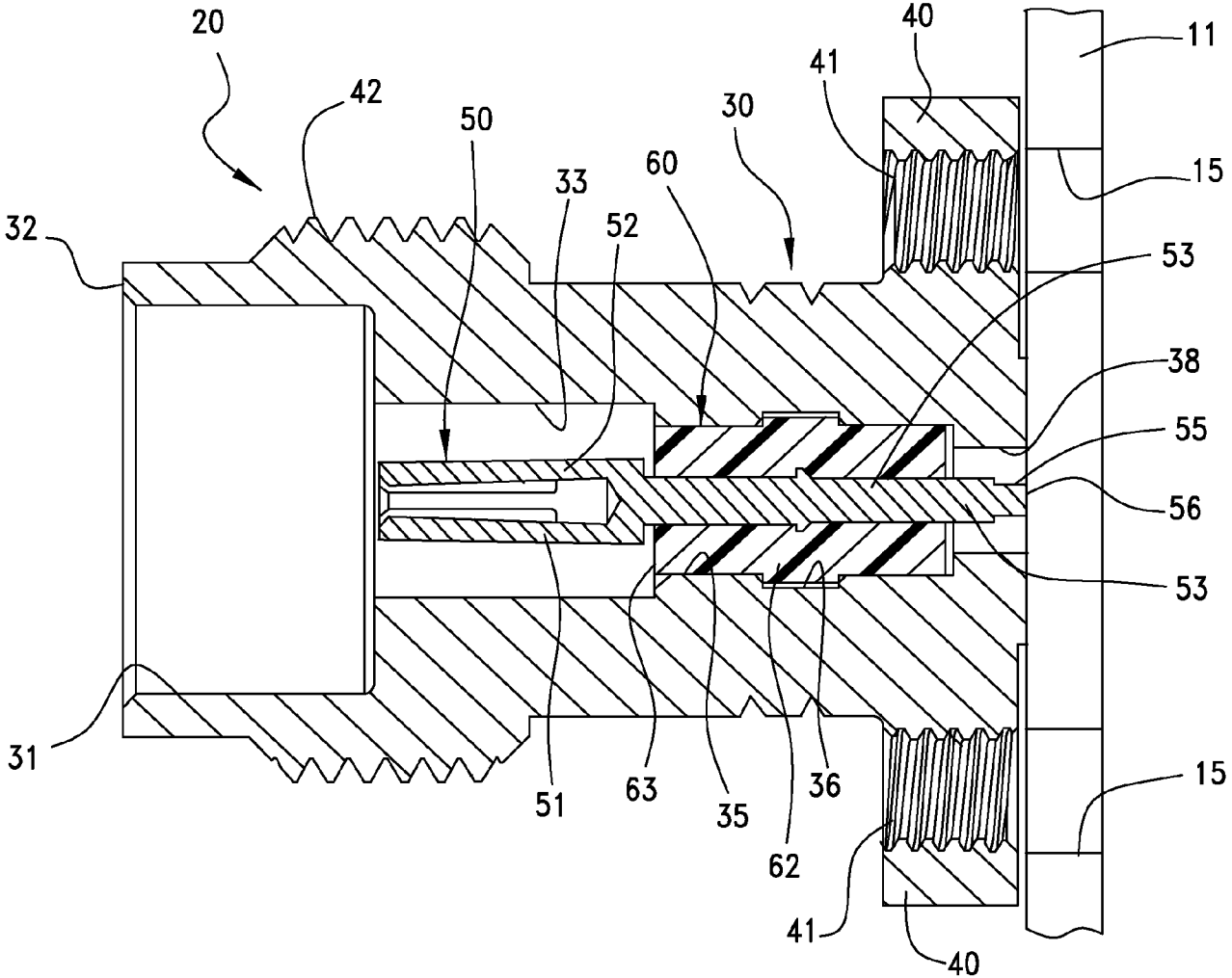
FIG. 4 is a section of taken generally along Line 4-4 of FIG. 3, but with a circuit member depicted.
Figure 5:
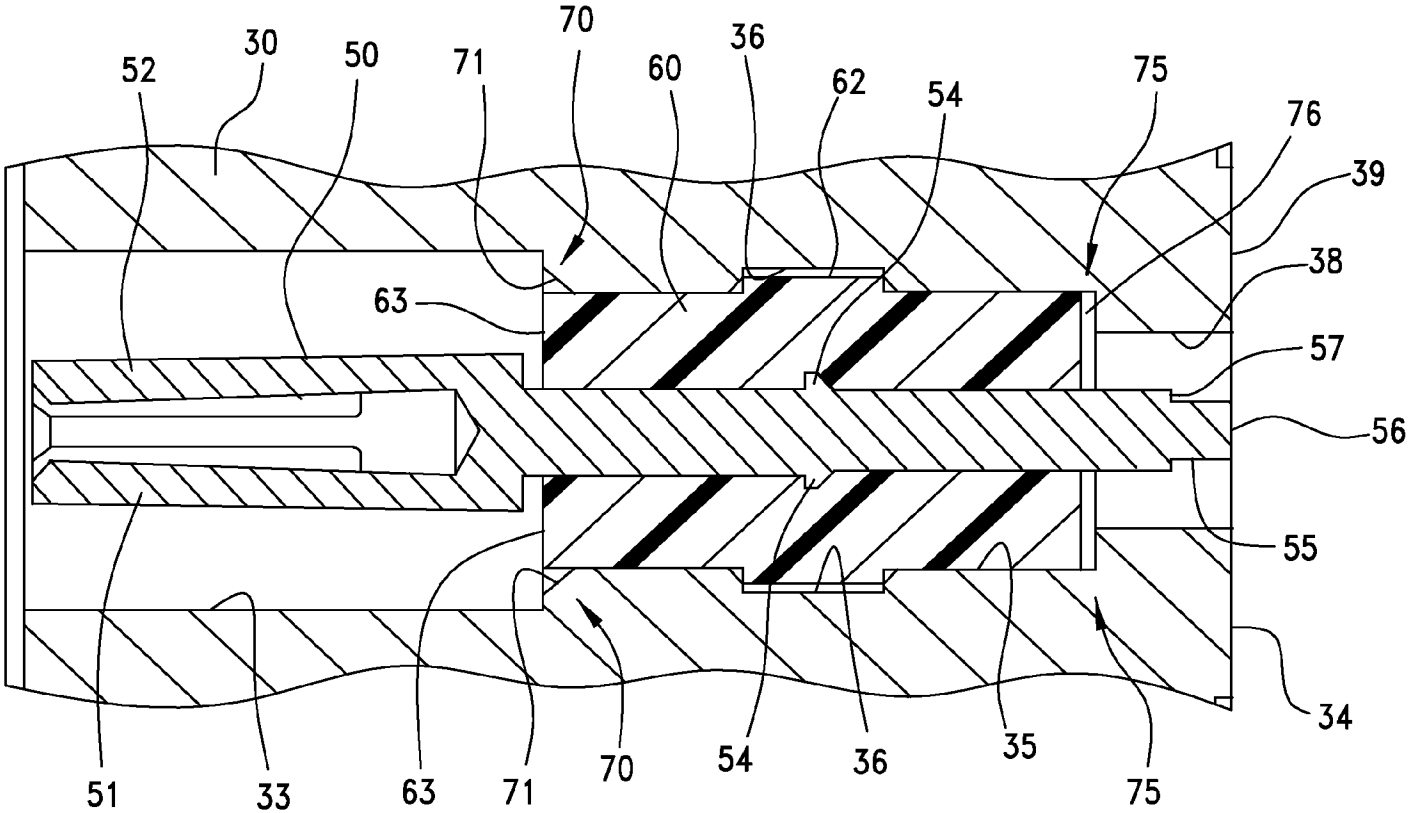
FIG. 5 is an enlarged view of a portion of FIG. 4.

Referring to FIGS. 2-5 coaxial connector 20 includes a conductive generally cylindrical body 30, a center contact 50 and an insulator therebetween such as a generally cylindrical dielectric insert 60. Body 30 includes a plurality of axially aligned sections. More specifically, a generally cylindrical alignment section 31 is located adjacent (to the left in FIG. 4) a mating end 32 of body 30 for receiving a portion of a mating component such as a mating connector (not shown). A generally cylindrical mating section 33 is located adjacent alignment section 31 and extends towards mounting face 34 of body 30 (to the right in FIG. 4). As best seen in FIGS. 4-5, mating section 33 has a smaller diameter than that of alignment section 31. Generally cylindrical dielectric insert section 35 is located adjacent mating section 33 and extends towards mating face 34 (to the right in FIG. 4). Dielectric insert section 35 has a diameter smaller than that of mating section 33. An enlarged annular recess 36 extends into body 30 generally adjacent the axial center or midpoint of dielectric section 35. The transition 70 between mating section 33 and dielectric insert section 35 includes a tapered surface 71 that functions as a mechanical guide to ease the insertion of dielectric insert 60 and as an electrical transition between mating section 33 and dielectric insert section 35. A generally cylindrical board mount section 38 is located between dielectric insert section 35 and mounting face 34 and is smaller in diameter than dielectric insert section 35.

Each of the alignment section 31, mating section 33, dielectric insert section 35 and board mount section 38 are generally cylindrical and coaxial with central axis 21 extending through coaxial connector 20. Mounting face 34 includes an annular projecting ridge 39 centered about central axis 21 for removably engaging reference pad 14 of circuit member 11. Body 30 has two mounting flanges 40 that extend from opposite sides thereof and each includes a threaded bore 41 into which a mounting screw 16 may be fixed in order to secure coaxial connector 20 to circuit member 11. The outer surface of body 30 may include threads 42 adjacent the alignment section 31 and the mating section 33 to secure coaxial connector 22 to a mating component (not shown). Body 30 may be formed of a conductive material such as stainless steel, CRES alloy or any other material that will provide similar functionality.

Center contact 50 has a mating end 51 with four deflectable contact beams 52 for engaging a mating member such as a pin (not shown) of a mating component and a generally cylindrical body or center pin 53 with a diameter smaller than that of mating end 51. End portion 55 of pin 53 has a reduced diameter adjacent mounting face 34 of body 30 and a flat end face 56 for removably engaging signal pad 13 of circuit member 11. A portion of pin 53 aligned with the annular recess 36 of dielectric insert section 35 includes an annular projection or ring 54 that functions as a barb to secure center contact 50 within dielectric insert 50. The mating end 51 of center contact 50 is positioned within mating section 33 along the central axis 21 of coaxial connector 20 while pin 53 extends from its mating end 51 to through dielectric insert section 35 and board mount section 38 to mounting face 34 of body 30. Center contact 50 may be formed of a resilient conductive material such as beryllium copper or any other material that will provide similar functionality.

Dielectric insert 60 is generally cylindrical with a central bore 61 through which central contact 50 is positioned. An annular projection or ring 62 extends around the outside surface of dielectric insert 60 generally adjacent its axial center or midpoint in order to secure the dielectric insert within dielectric insert section 35 of body 30. More specifically, upon inserting dielectric insert 60 into dielectric insert section 35, annular ring 62 is received within annular recess 36 of dielectric insert section 35 in order to secure the dielectric insert therein. As described below in more detail, the axial length of dielectric insert 60 (left to right in FIGS. 4-5) is slightly shorter than the axial length of dielectric insert section 35 in order to form or leave a gap 76 between the end of the dielectric insert 60 closest to mounting face 34 and the end of the dielectric insert section 35 closest to mounting surface 34. Dielectric insert may be formed of a rigid or semi-rigid insulator such as polytetrafluoroethylene or any other material that will provide similar functionality.

As high frequency signals pass through coaxial connector 20, any variations in impedance along the circuit path will result in degradation of the signal. Changes in the physical or geometrical relationships between the body 30 and the center contact 50 as well as the dielectric material between the body and center contact may cause a change in impedance along the signal path which can increase return loss, especially at high frequencies. In order to maintain a desired impedance (e.g., 50 ohms) along the length of coaxial connector 20, the inner diameter of mating section 33 of body 30 is selected based upon the dimensions of the mating end 51 of center contact 50 as well as the electrical characteristics of body 30 and the dielectric material (e.g., air) between the mating end 51 and body 30. Pin 53 of center contact 50 has a smaller diameter than the mating end 51 of center contact 50 and dielectric insert section 35 of body 32 further includes dielectric insert 60 surrounding the length of pin 53 (except for air gap 76). Accordingly, based upon the smaller diameter of pin 53 as well as the presence of dielectric insert 60, the diameter of dielectric insert section 35 is selected to also provide the desired impedance (e.g., 50 ohms). Based upon the use of air as a dielectric between the pin 53 and board mount section 38 of body 30, the board mount section is smaller in diameter than either the mating section 33 or the dielectric insert section 35 in order to maintain the desired impedance (e.g., 50 ohm).

A significant issue when high frequency signals pass through any connector is that the changes in geometry and dielectric materials may result in significant changes in impedance. With frequencies, such as those over 30 GHz, even small changes in impedance may cause significant reflection of signals and return loss. Accordingly, as best seen in FIGS. 4-5, various features are included within coaxial connector 20 in order to reduce the impact of any changes in geometry along the signal path.

A first transition region 70 is provided between the relatively large diameter of mating section 33 of body 32 and the smaller diameter of dielectric insert section 35. Body 30 includes an annular tapered surface or lead-in 71 that has an electrical function of gradually changing the electrical characteristics along the electrical path rather than creating an abrupt change as would be present with a step or rapid change in diameter. In other words, due to the gradual taper between the mating section 33 and the dielectric insert section 35, the distance between the body 30 and pin 53 decreases in a gradual manner and thus the impact on the impedance is gradual. It should be noted that the tapered surface 71 also provides a mechanical function of acting as a lead-in to facilitate the insertion of dielectric insert 60 into dielectric insert section 35 of body 30. In addition to the tapered surface 71, abrupt impedance changes are also reduced at transition region 70 by extending the dielectric insert 60 forward towards the mating end 51 of central contact 50 (to the left in FIGS. 4-5). More specifically, the forward end 63 of dielectric insert 60 is generally aligned with the forward edge 72 of annular tapered surface 71. As a result, the transition between the mating section 33 and dielectric insert section 35 includes two aspects in order to smooth or reduce changes in impedance as signals pass from mating section 33 to dielectric insert section 35. First transition region 70 includes annular tapered surface 71 which gradually reduces the inside diameter of body 30 and thus gradually changes the distance from center contact 50 and also includes the forward end 63 of dielectric insert 60 which extends into the first transition region to change the dielectric material between the center contact 60 and body 30 as compared to the air dielectric between mating end 51 of center contact 50 and mating section 33 of body 32.

A second transition region 75 is provided as the dielectric insert section 35 transitions to the smaller diameter of board mount section 38. At such transition, an alternate manner of smoothing changes in impedance is depicted. At the second transition region 75, the body 30 undergoes an abrupt change in diameter from the relatively larger diameter of dielectric insert section 35 to the smaller diameter of board mount section 38. In addition, the dielectric between body 30 and center contact 50 changes from the dielectric insert 60 to air.

In order to compensate for the abrupt change in diameters between the dielectric insert section 35 and board mount section 38 as well as the change in dielectric material positioned between the pin 53 and body 30, the dielectric insert 60 is dimensioned so that it does not extend to the end of dielectric insert section 35 adjacent board mount section 38 (to the right in FIGS. 4-5). This configuration creates an air gap 76 so that the pin 53 adjacent the second transition region 75 includes three distinct configuration to facilitate the transition. In the first configuration, pin 53 and dielectric insert section 35 have a first spacing with dielectric insert 60 positioned therebetween. In the second configuration, pin 53 together with the dielectric insert section 35 remain at the same first spacing but the dielectric insert is removed so that air (of air gap 76) acts as the dielectric between the center contact 50 and body 30. In the third configuration, the diameter of pin 53 remains unchanged but the diameter of board mount section 38 is smaller with air acting as a dielectric between the center contact 50 and the body 30. These three sequential configurations act to smooth or reduce any changes in impedance through the second transition region 75.

At high frequencies, the annular ring 54 of center contact 50 as well as annular recess 36 within dielectric insert section 35 of body 30 and annular ring 62 of dielectric insert 60 could each act as discontinuities that may affect the electrical performance of the coaxial connector 20. In order to minimize the electrical impact of these components, the annular ring 54 of center contact 50 is axially aligned with the annular recess 36 and the annular ring 62. More specifically, if the annular ring 54 existed without the annular recess 36, the distance between the body 30 and center contact would be reduced which would reduce the impedance at that location and create an impedance discontinuity that may have an impact on the system performance.

The end portion 55 of pin 53 includes a reduced diameter section in order to further maintain the impedance matching function of coaxial connector 20. Upon mounting coaxial connector 20 on circuit member 11, the signal pad 13 of circuit member 11 is in contact with the end face 56 of center contact 50 and annular projecting ridge 39 at mounting face 34 is in contact with annular ground pad 14 on circuit member 11. In order to reduce impedance discontinuities at the interface between pin 53 and signal pad 13, end portion 55 has a reduced diameter in order to maintain the desired impedance (e.g., 50 ohm). While the change in diameter is depicted as a step 57, the change in diameter could be gradual, such as one formed by a taper, if desired.

Various modifications of the features described above for reducing the impact of changes in geometry along the signal path may be made. For example, tapered surface 71 is depicted in the FIGS. 4-5 as a 45° angle. Other angles could also be used to change the diameter between sections of the body. Depending on the angle selected, the impact of the change will be either more or less gradual. In addition, the positioning of the dielectric insert 60 will also impact the affect of the transitions in geometry. For example, moving the forward end 63 of the dielectric insert 60 will also impact the impedance. Other modifications could also be made such as tapering the insert at one or both ends.

Figure 6:
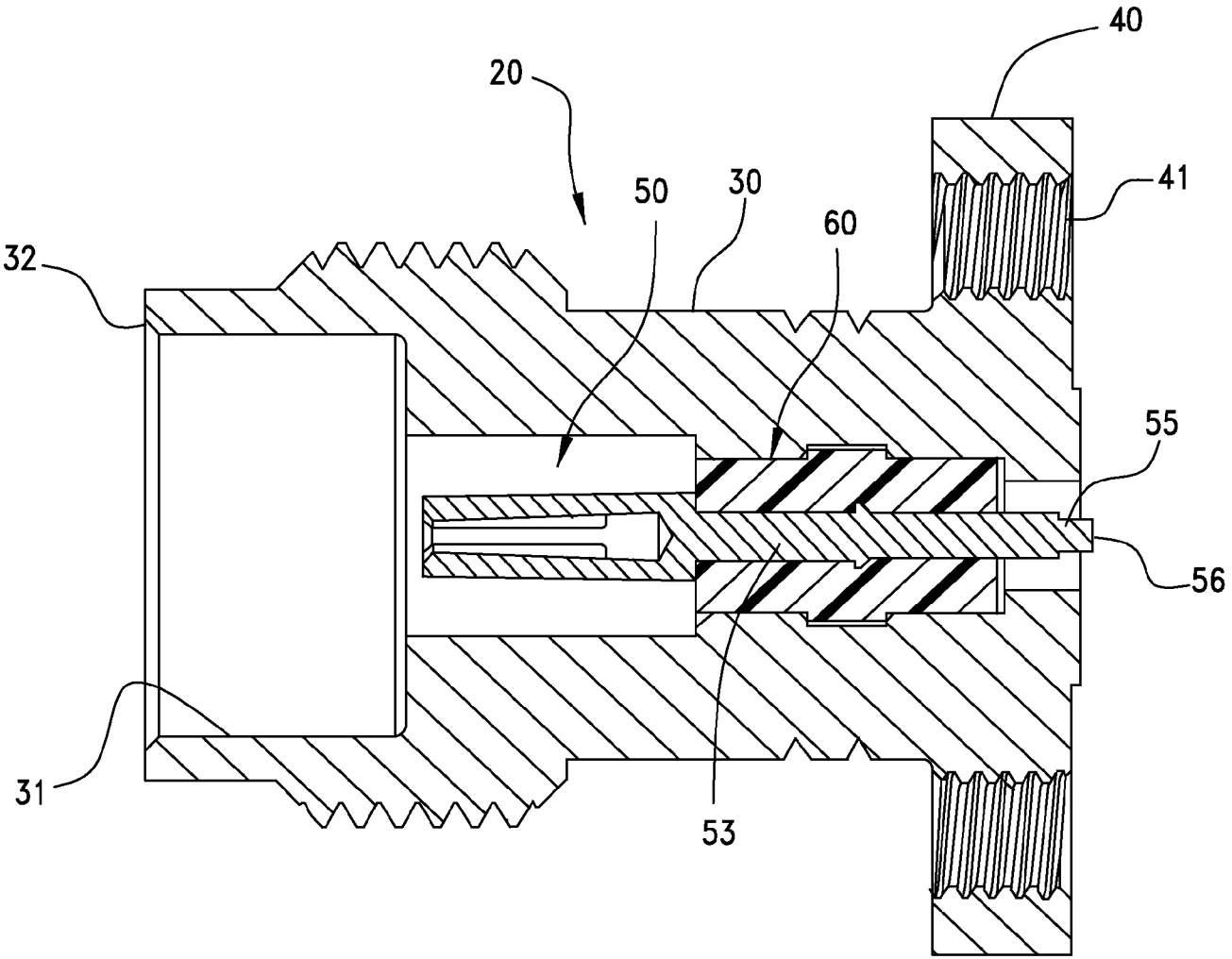
FIG. 6 is a section similar to FIG. 4, but with the center contact in its pre-board mounted position.

During assembly, the center contact 50 is inserted into bore 61 of dielectric insert 60. The center contact and dielectric insert subassembly is then inserted through the alignment section 31 and mating section 33 along central axis 21 so that dielectric insert 60 enters dielectric insert section 35. Dielectric insert 60 is forced into place within dielectric insert section 35 until the annular ring 62 of dielectric insert 60 fits within annular recess 36 within dielectric insert section 35 in order to secure the center contact and dielectric insert in place. It should be noted that in such condition, the end face 56 of center contact 50 extends beyond the mating face 34 of body 30 (FIG. 6). Upon mounting coaxial connector 30 on circuit member 11 and inserting mounting screws 16 through mounting holes 15 in circuit member 11 and into bores 41 of body 30, end face 56 of center contact 50 is forced against signal contact 13 of circuit member 11. Tightening mounting screws 16 provide sufficient force to slide center contact 50 within dielectric insert 60 along central axis 21 so that both end face 56 of pin 53 remains sufficiently engaged with signal pad 13 and annular projecting ridge 39 of mounting face 34 remains sufficiently engaged with reference pad 14 in a coplanar manner as depicted in FIG. 4. Utilization of mounting screws 16 and the butt or surface engagement between end face 56 and signal pad 13 as well as the engagement between annular projecting ridge 39 and ground pad 14 simplifies mounting of coaxial connector 20 on circuit member 11 and provides a consistent interface between the connector and circuit member in order to reduce impedance mismatches and minimize return loss. In other words, coaxial connector 20 is mounted to circuit member 11 without soldering the connector in place which simplifies the process of applying the connector to the circuit member and permits subsequent removal of the connector, if desired.

In one example of coaxial connector 20, approximate dimensions are as follows: the diameter of mating section 33 of body 30 is 0.0945 in., the diameter of dielectric insert section 35 is 0.074 in., the diameter of annular recess 62 is 0.086 in., and the diameter of board mount section 38 is 0.052 in.; the diameter of dielectric insert 60 is 0.072 in. and the diameter of annular ring 62 is 0.08 in.; the diameter of pin 53 of center contact 50 is 0.022 in. and the reduced diameter end portion 55 is 0.016 in. in diameter and has a length of 0.308 in.; and the axial length of dielectric insert section 35 (from board mount section 38 to the mating section 33) is 0.143 in. and the axial length of dielectric insert is 0.138 in. It is believed that the length of the reduced diameter end portion 55 will function within a range of between 0.10 and 0.20 in. In testing in which two coaxial connectors having the dimensions described above where clamped back-to-back, the voltage standing wave ration for the pair of connector remained below 1.2 (which equates to a return loss of greater than 20 dB) within a range of frequencies from approximately 125 MHz to 50 GHz.

While a preferred embodiment of the Present Disclosure is shown and described, it is envisioned that those skilled in the art may devise various modifications without departing from the spirit and scope of the foregoing Description and the appended Claims.

What is claimed is:

1. A connector for mounting on a mounting surface of a circuit member, the circuit member including a signal pad and a reference pad, comprising:

a conductive body having a central bore along a central axis, the coaxial body including a mounting face for positioning adjacent the mounting surface of the circuit member and removably engaging the reference pad, the central bore including a first mating section, a second dielectric insert section and a third board mount section sequentially along the central axis, the first mating section having a first diameter, the second dielectric insert section being located between the first mating section and the third board mount section and having a second diameter smaller than the first diameter, the third board mount section being located between the second dielectric insert section and the mounting face and having a third diameter smaller than the second diameter;

a center conductive contact positioned along the central axis and extending within the first mating section, the second dielectric insert section and the third board mount section of the conductive body, the conductive contact including a mating contact end for mating with a mating component and a board engaging end for removably engaging the signal pad of the circuit member;

an inner dielectric insert positioned within the second section of the conductive body between the conductive body and the center conductive contact;

a first transition region between the first mating section and the second dielectric insert section and a second transition region between the second dielectric insert section and the third board mount section, the first and second transition regions being configured to minimize the impact of changes in geometry and dielectric material between the center conductive contact and the conductive body.

2. The connector of claim 1, wherein the circuit member is generally planar and the central axis is generally perpendicular to the plane of the circuit member.

3. The connector of claim 2, wherein the board engaging end of center conductive contact is generally planar and configured to engage the signal pad of the circuit member in a butt configuration.

4. The connector of claim 2, wherein the center conductive contact has a reduced diameter section adjacent the mounting face.

5. The connector of claim 4, wherein the reduced diameter section is greater than 0.010 inches in length.

6. The connector of claim 2, wherein the inner dielectric insert is spaced from the third board mount section.

7. The connector of claim 1, wherein the first transition region includes tapered surface between the first mating section and the second dielectric insert section defining a tapered region.

8. The connector of claim 7, wherein the first transition region further includes the inner dielectric insert extending into the tapered region.

9. The connector of claim 1, wherein the second transition region includes the inner dielectric insert being shorter than the length of the second dielectric insert section in order to create an air gap within the second dielectric insert section between the body and the center conductive contact.

10. The connector of claim 1, wherein the mounting face includes an annular ridge extending from a generally planar surface thereof for engaging the reference pad.

11. A connector for mounting on a mounting surface of a circuit member, the circuit member including a signal pad and a reference pad, comprising:

a conductive body having a central bore along a central axis, the conductive body including a mounting face for positioning adjacent the mounting surface of the circuit member and removably engaging the reference pad;

a center conductive contact positioned along the central axis and including a mating contact end for mating with a mating component and a board engaging end for removably engaging the signal pad of the circuit member, the center conductive contact having a reduced diameter section adjacent the mounting face; and an inner dielectric insert positioned between the conductive body and the center conductive contact;

wherein the conductive body, the center conductive contact and the inner dielectric insert are configured to operate at a frequency of at least 40 GHz with a return loss of greater than 20 dB.

* * * * *